US005694963A

United States Patent [19]

Fredell et al.

[11] Patent Number: 5,694,963

[45] Date of Patent: Dec. 9, 1997

[54] METHOD AND APPARATUS FOR FREEZE PREVENTION OF IRRIGATION SYSTEMS

[76] Inventors: Paul Thomas Fredell, 1404 Keaton La., Colorado Springs, Colo. 80909; Brett William Floyd, 7426 Park Lane Rd., Longmont, Colo. 80503; Marc Jay Stein, 15220 Steinbeck La., Colorado Springs, Colo. 80921

[21] Appl. No.: 566,612

[22] Filed: Dec. 4, 1995

[51] Int. Cl.[6] ..... E03B 7/12; F16L 53/00; F16L 55/07

[52] U.S. Cl. ..... 137/2; 137/61; 137/782; 137/80; 137/551; 137/557; 137/624.18; 340/581; 340/611

[58] Field of Search ..... 137/59, 61, 62, 137/78.3, 79, 80, 312, 557, 78.1, 78.2, 624.18, 2, 551; 340/603, 620, 581, 611; 237/63, 64, 69, 70, 80

[56] References Cited

PUBLICATIONS

Hasslinger Manufacturing Corporation, Sales Literature ©1996, NO FREEZE™ Patent Pending.

The Toro Company, Spec Sheets ©1993, "The MIR5000c Central Controller," The MIR5000i Satellite and MIR5000s Remote I/O Unit, The MIR5000f Field Satellite, and Motorola MIR5000 System Features.

Rain Bird Sprinkler Mfg. Corp., Sales Literature ©1992, MAXICOM© Central Control System and Schematic.

Rain Bird Sprinkler Mfg. Corp., Tech Specs ©1994, "Central Output Module, Decoders, Weather Station, SBM Satellite, ISC Satellite, and Cluster Control Unit".

*Primary Examiner*—George L. Walton
*Attorney, Agent, or Firm*—William J. Kubida; John R. Wahl; Holland & Hart LLP

[57] ABSTRACT

There is disclosed an apparatus for freeze prevention protecting an irrigation system. The response of the apparatus depends on environmental conditions. At a first temperature condition, the irrigation system is shut down. At a lower temperature condition, the system remains shut down and heat is delivered to the above ground portions of the system. In the event temperatures continue to decrease, a full drainage of the above ground portion of the irrigation system will be accomplished and alarm notification will be given.

18 Claims, 4 Drawing Sheets

METHOD AND APPARATUS FOR FREEZE PREVENTION OF IRRIGATION SYSTEMS

BACKGROUND OF THE INVENTION

1. Field of the Invention

This invention relates to irrigation systems and more particularly to a method and apparatus for protecting irrigation systems from freezing conditions and associated hazards.

2. Description of Relevant Art

Restricted water usage, high water and labor costs, and the overall need to conserve our country's natural resources have led to the need for and systems which promote cost-effective water management of irrigation systems. Irrigation system controllers range in complexity from systems operated in a residential setting by an electromechanical timer to systems operating a municipal system of parks with local controllers linked by satellite to a command center. These latter systems monitor and control flow and usage of water at various sites based on rainfall, evaporation and transpiration rates and other environmental factors.

The goal of all automated irrigation systems is not only to efficiently manage water resources but also to obviate the need for extensive human site level intervention. Systems currently on the market will detect valve failures or pressure drops and broadcast these back to the central controller to shut down the irrigation of a zone within a system. Examples of these higher end systems are systems provided by Rainbird® Water Management Systems, specifically their Maxicom® product line, and by Toro®, specifically that company's MIR 5000® series system.

In winter all irrigation systems are shut down and winterized. Late in the fall of each irrigation season irrigation systems in freezing climates are vulnerable to an extended period of freezing occurring before system winterization. There are two potential hazards resulting from operation during this time of year. First, if irrigation water sprays on pedestrian walkways during freezing weather, there is a danger of ice buildup and physical injury resulting from a trip and fall accident. Secondly, during freezing weather above ground components of the irrigation system may freeze and break. Pipe, for example, may rupture as water turns to ice. Perhaps the most vulnerable component of an irrigation system is the backflow preventor. This component is just downstream of the municipal water supply valve and serves to prevent backflow from the irrigation system into the municipal supply in the event there is a pressure drop in the municipal supply. Building code in most areas requires that this expensive component be positioned at least one foot above ground level. It, therefore, is susceptible to freeze damage resulting from early frosts occurring before the system is closed down for the winter.

Closing down an irrigation system usually involves a complete draining of the system by on-site labor. Scheduling labor for the extensive task of winterizing an irrigation system, particularly in a municipal context, can be a lengthy task. There is pressure on the part of the public to extend the growing season as late in the year as possible, and therefore, scheduling system shutdown is often delayed until winter approaches. At that point in time, scarce labor resources require that irrigation systems be closed down on a scheduled basis. Under these conditions the likelihood of frost damage to systems which have not been winterized is increased.

Therefore, a need exists for a method and apparatus for protecting an irrigation system from an early freeze condition occurring before a system has been winterized.

SUMMARY OF INVENTION

The present invention in general terms concerns an apparatus and method for protecting an irrigation system from freeze damage caused by an early frost occurring before winterization of the irrigation system.

The components of the system are a freeze prevention controller, a remotely controlled main feedwater supply valve, a pressure sensor, two drain valves, two vent valves, and an optional heating unit. These are connected to the irrigation controller and to the irrigation supply valve(s). The freeze prevention controller comprises an environmental sensing unit, a pressure sensing unit, a sequential logic unit, a plurality of switching units, and an alarm unit. The environmental sensing unit comprises at least one temperature sensing unit.

The main, vent, and irrigation valves are connected to switching units of the freeze prevention controller. Drain valves may be pressure actuated or connected to freeze prevention controller switching units. The pressure sensor monitors irrigation line pressure between the main valve and the backflow preventor and transmits this information to the pressure sensing unit of the freeze prevention controller. The optional heating unit is in thermal contact with the above ground components of the irrigation system and is controlled by a switching unit of the freeze prevention controller. The alarm unit is also connected to a switching unit so it may be energized or de-energized as required.

In operation, signals received from the environmental sensing units, of the freeze prevention controller will indicate hazardous environmental conditions requiring either partial or full shutdown of the irrigation system. If, for example, the temperature falls below a primary temperature set point, rendering it advisable to cease the irrigation cycle, then under these conditions the irrigation supply valve(s), normally driven directly by the irrigation controller unit, will be disabled to prevent freezing of sprinkler heads and/or freezing of water on sidewalks and pathways. If the temperature goes back above the primary temperature set point, then the irrigation valve(s) will be re-enabled by the freeze prevention controller circuit.

Under more severe conditions, if the temperature drops below a secondary temperature set point, as determined by one of the environmental sensors, a heating unit will be energized to protect the above ground portions of the system from freezing. If the system recovers above the secondary temperature set point, the heating will be shut off and if the temperature goes back above the primary temperature set point then the irrigation valve(s) will be re-enabled.

Finally, in the most severe conditions, if the temperature drops below a tertiary temperature set point, as sensed by the environmental sensors, the freeze prevention controller will shut down and drain the above ground portion of the irrigation system.

System shut down occurs by closing of the main feedwater supply valve, opening of the vent valves, a low pressure indication from the pressure sensor, and the opening of all drain valves. The shut down status of the system is announced locally and/or remotely by the alarm unit of the freeze prevention controller.

Accordingly, it is a primary object of the present invention to provide an economical method for freeze protecting of irrigation systems. It is another object of the invention to provide an apparatus to practice the method of freeze protection of irrigation systems. Other aspects, features, and details of the present invention can be more completely understood by reference to the following detailed description of a preferred embodiment taken in conjunction with the drawings in the appended claims.

DESCRIPTION OF THE PREFERRED EMBODIMENT

While the method and apparatus of the present invention may serve other desirable functions, e.g., freeze prevention of any liquid supply system, for purposes of this disclosure, it is being described as directed to freeze prevention of an irrigation system.

Figure 1:
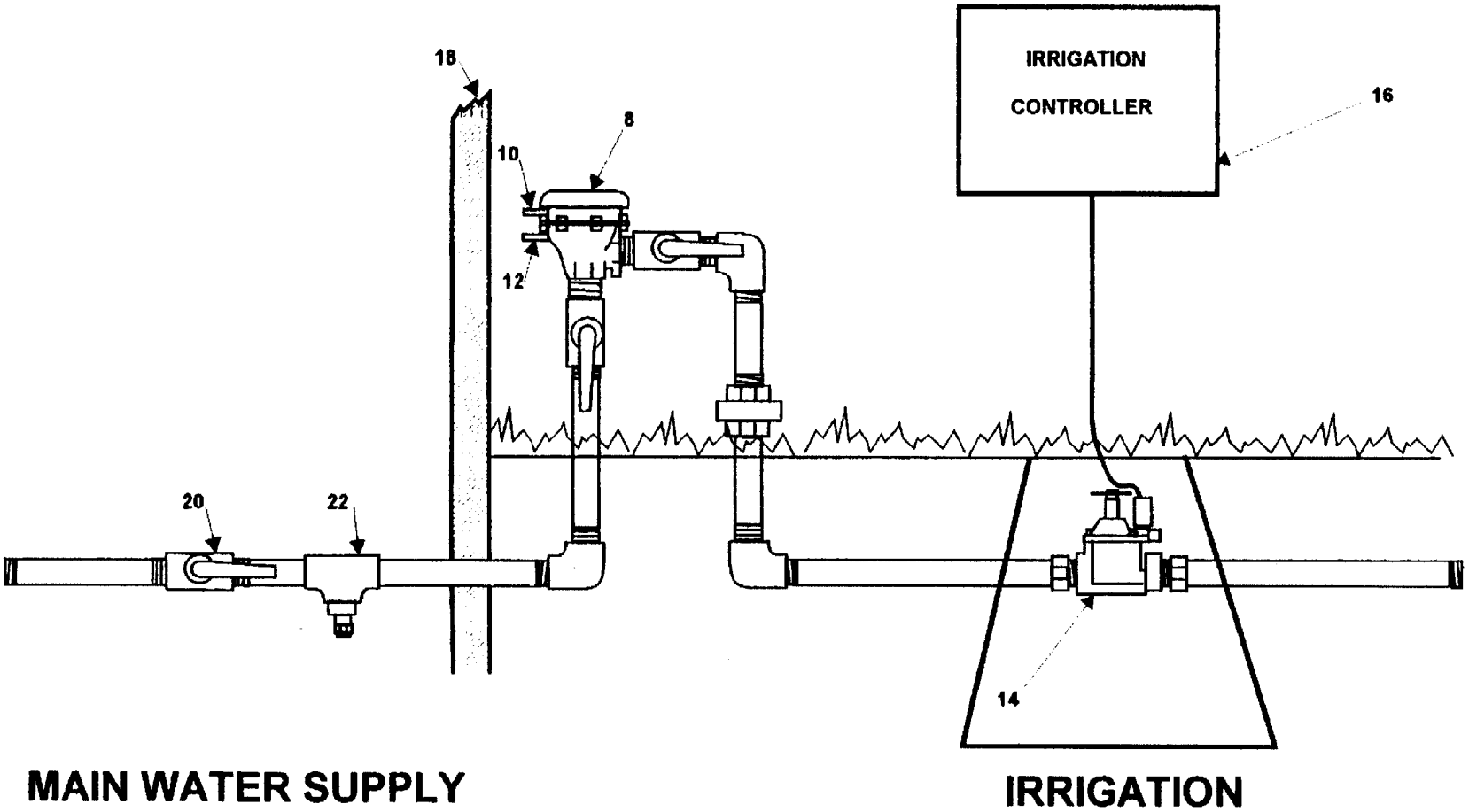
FIG. 1 PRIOR ART
FIG. 1 is a side elevation of an irrigation system and controller of the prior art.

The prior art irrigation system is shown in FIG. 1 and consists of a manual feedwater supply valve 20 and manual drain 22 connected to a backflow preventor 8, which backflow preventor has vents 10, 12. The backflow preventor is in turn connected by means of a remotely controlled irrigation valve 14 to an irrigation network. The irrigation valve 14 is controlled by irrigation controller 16. Wall 18 separates the enclosed feedwater supply portion of the irrigation system from the environmentally exposed portions.

Figure 2:
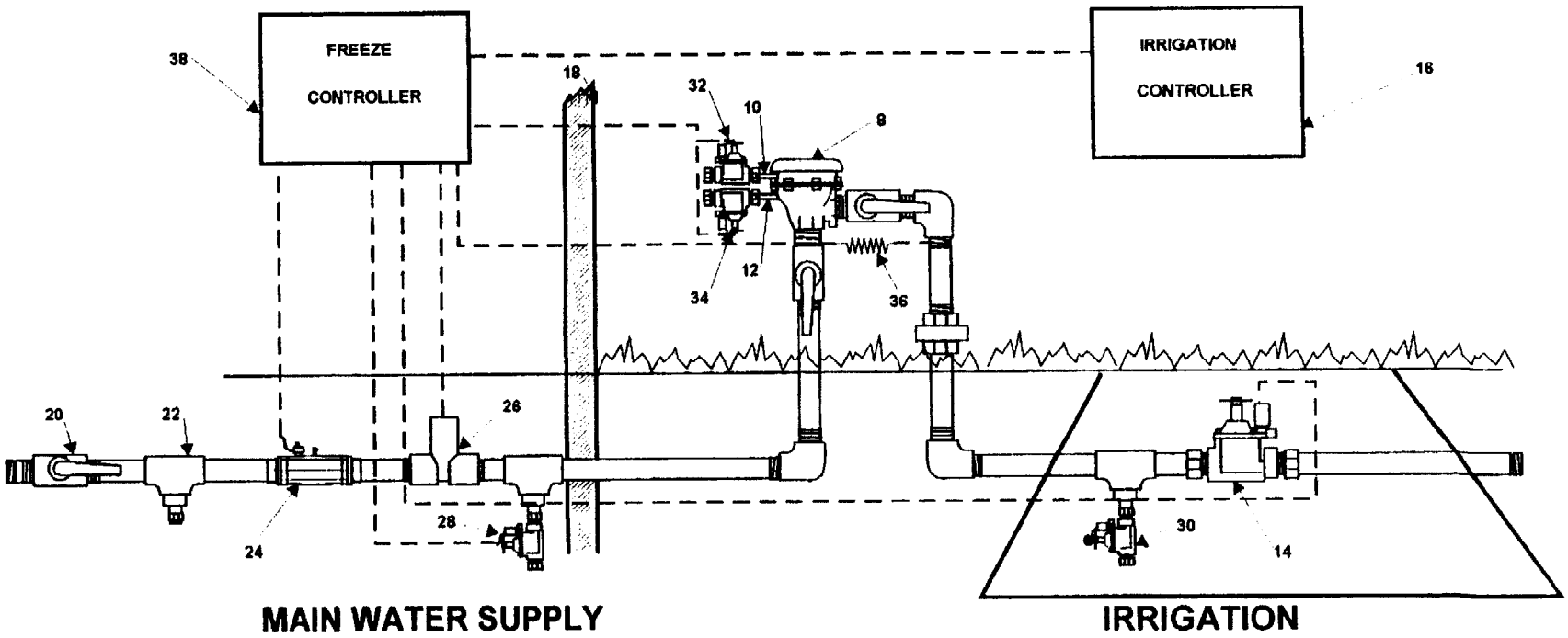
FIG. 2 is a side elevation of an irrigation controller and freeze prevention controller of the current invention.

The apparatus of the current invention is shown in FIG. 2 and consists of a freeze prevention controller 38 connected to an irrigation controller 16. The freeze prevention controller 38 has connections to: a remotely controlled main feedwater supply valve 24; a pressure sensor 26; vent valves 32, 34; and drain valves, 28, 30 on either side of the backflow preventor 8. In an alternate embodiment drain valves 28, 30 can be biased check valves which will mechanically open and drain the line when line pressure falls below a certain level. The backflow preventor vents 10, 12 are hooked respectively to vent valves 32, 34. The above ground portion of the system is in thermal contact with heating unit 36 which is in turn connected to the freeze prevention controller 38. The freeze prevention controller 38 is connected to irrigation valve 14 and irrigation controller 16.

Figure 3:
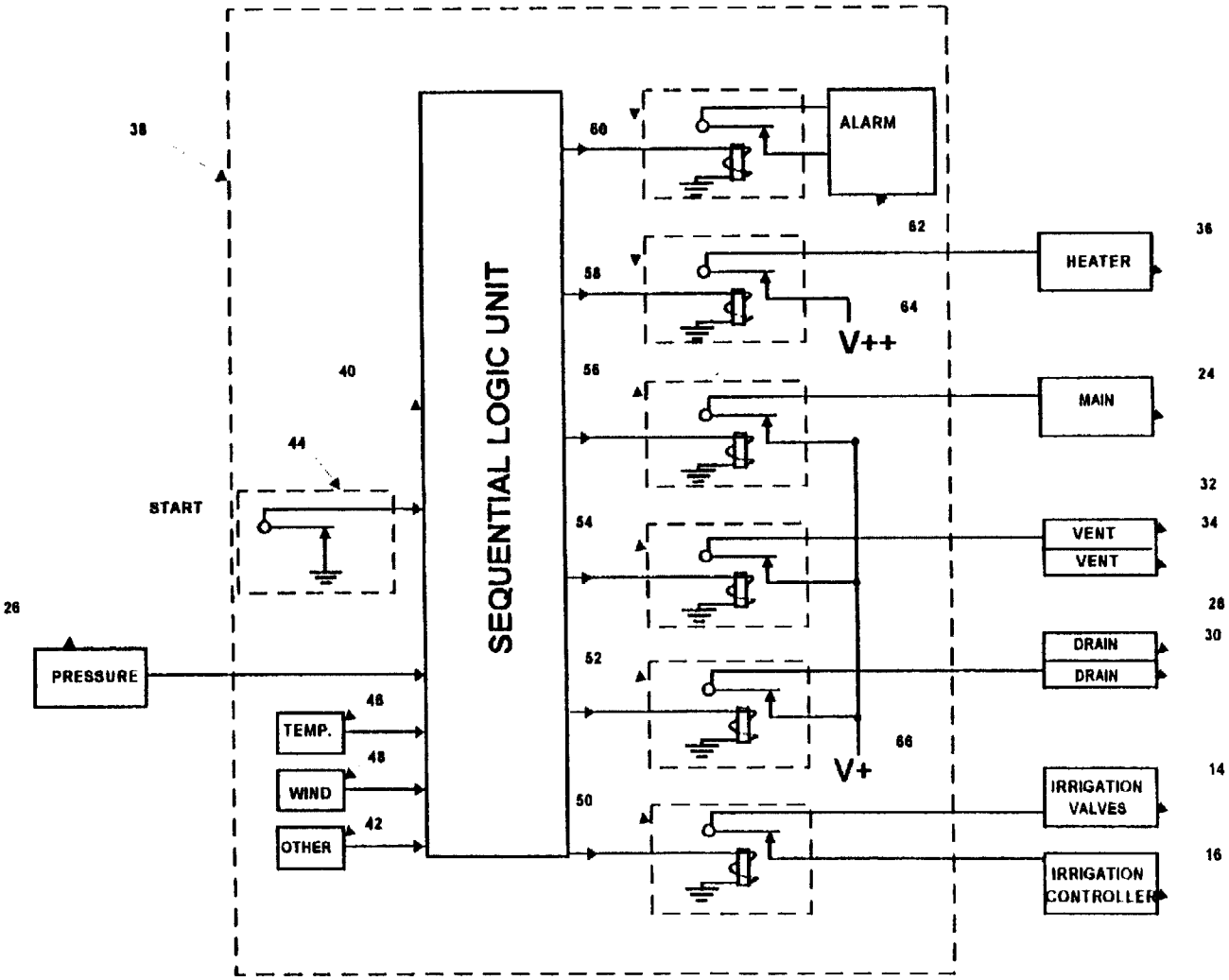
FIG. 3 is a hardware block diagram of the major system components of the freeze prevention controller.

The freeze prevention controller 38 is shown in greater detail in FIG. 3. The controller consists of a sequential logic unit 40 with a plurality of units for sensing environmental conditions, system pressure and startup/shutdown input from a user. It has switching units to control the opening/closing of valves/drains, enabling/disabling the heater and alarm unit, and displaying system status.

The sequential logic unit 40 is connected to environmental sensors for temperature 46, wind 48, and other relevant environmental factors 42. Other inputs to the sequential logic unit are startup/shutdown circuit 44, pressure sensor 26, alarm reset 68, and sequential logic unit power 70. Power supply 72 is connected to alarm reset unit 68, to startup/shutdown circuit 44, and to sequential logic unit power 70.

The sequential logic unit is connected to a plurality of switching units. Switch unit 50 connects in series between the irrigation controller 16 and the irrigation supply valve 14. Switch unit 52 supplies power to drain valves 28, 30. Switch unit 54 supplies power to vent valves 32, 34. Switch unit 56 controls the main feedwater supply valve 24. Power supply 66 is connected to switch units 52, 54 and 56. Switch unit 58 supplies power to heating unit 36. Power supply 64 is connected to switch unit 58. Switch unit 60 activates alarm unit 62. The alarm unit may range in complexity from a simple audio/visual alarm indicator to an alarm and system condition broadcast to a remote command center.

Figure 4:
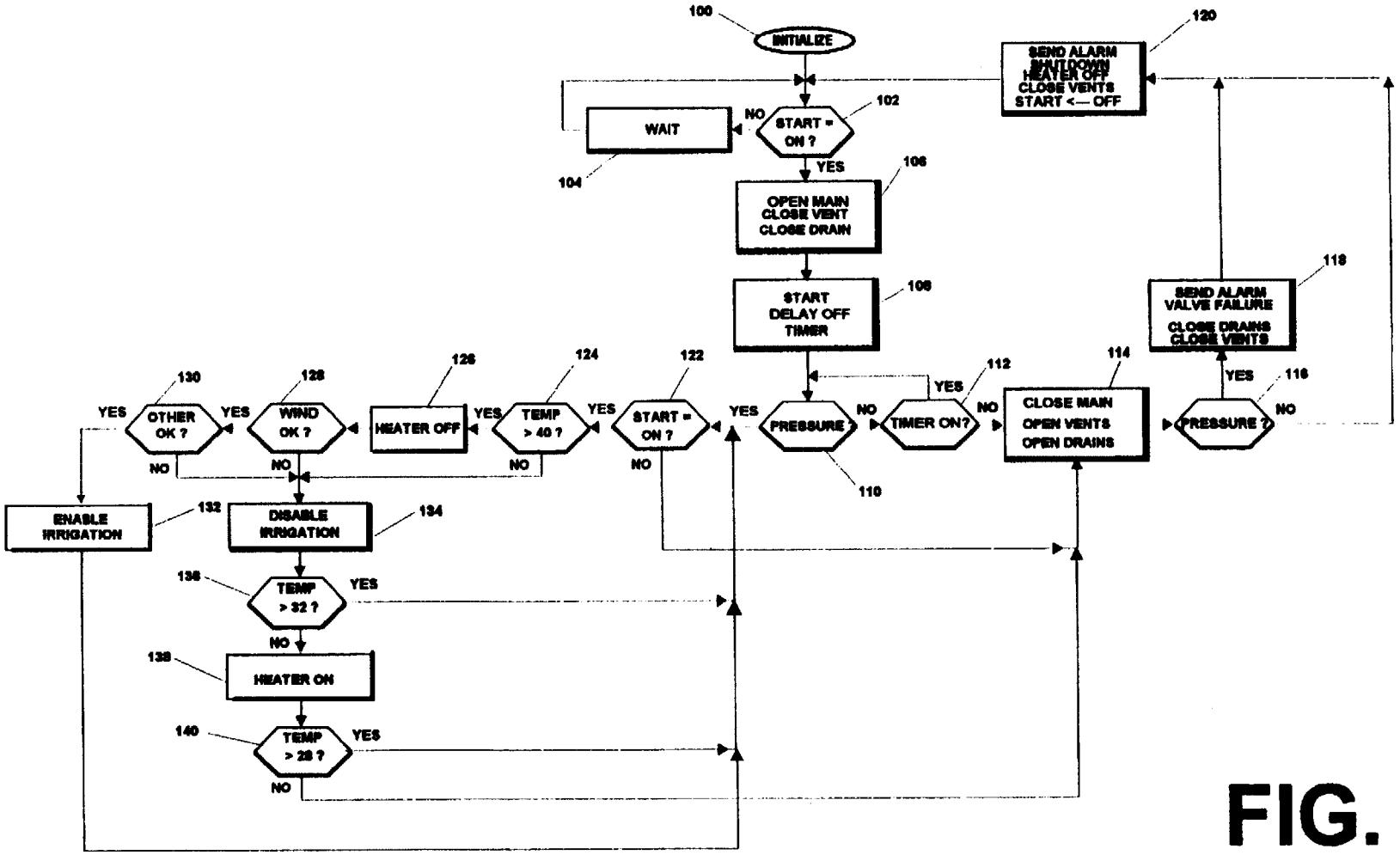
FIG. 4 is a process flow diagram of the main processes involved in the freeze prevention controller.

The operation of the system is shown in process flow FIG. 4 in which the system is initialized in step 100 and in which subsequently in decision process 102 it is determined whether the alarm unit is in a reset condition. If the alarm unit is in a reset condition then control is passed to decision process 104. If the alarm unit is not in a reset condition then control is not passed to decision process 104. In decision process 104 a determination is made as to whether the register Start is in the On condition. If the register Start is in the On condition then control is passed to process 106. If the register Start is not in the on condition then control is not passed to process 106. In process 106 the main feedwater supply valve 24 is opened; vents 32, 34 are closed; and drains 28, 30 are closed. Control is then passed to process 108 in which a delay-off timer function in the sequential logic unit 40 is initiated.

Control is then passed to decision 110 in which a determination is made utilizing pressure sensor 26 as to whether pressure is building up in the portion of the supply line downstream from the main feedwater supply valve. If this determination is in the negative, control is passed to decision 112 in which a determination is made as to whether the delay-off timer initiated in process 108 is, in fact, off. In the event the timer is still on, then time remains for water to fill the supply lines and for pressure to build up, and control is passed back to decision 110. If alternately pressure is low and delay-off interval has passed, then the interval during which pressure should have built up if the system was operating normally has passed and control is then passed to process 114 in which the main feedwater supply valve 24 is closed, and vent 32, 34 and drains 28, 30 are opened. At this point in time the control is passed to decision 116 in which a determination is made as to whether pressure continues to be low indicating that the main feedwater supply valve 24 has been successfully closed. If a determination is reached that pressure has indeed dropped, indicating that the main feedwater supply valve has been successfully closed, then control is passed to process 120 in which alarm unit 62 is activated, indicating that a shut down of the circuit has been accomplished and that operator intervention is required to re-initiate the system. The heater circuitry for heating unit 36 is de-energized, the vent valves 32, 34 are closed, and a register Start is loaded with an Off condition. Control is then passed back to decision 102 and remains at that decision step until such time as the alarm is reset by an operator.

If alternately in decision 116 a determination is made that despite the fact that the main feedwater supply valve has been closed in process 114, there is still pressure in the line, then control is passed to process 118 in which an alarm condition is initiated to indicate that there is a probability that the main feedwater supply valve closure mechanism has failed. Additionally drains 28, 30 and vents 32, 34 are closed, and control is then passed to process 120 in which an alarm condition indicating system close down is initiated, the heating unit 36 is shut off, vent valves 32, 34 are closed, and the register Start is loaded with an Off condition. Control is then passed to decision process 102 for a determination of the alarm reset condition.

If alternately in decision 110 a system start is followed by a high pressure condition indicating both proper opening of the main feedwater supply valve 24 and closure of the vent and drain valves, 32, 34 and 28, 30 respectively, then control is passed to decision 122 in which the Start register condition is analyzed. If it is determined that the Start register is in an Off condition, then control is passed directly to shutdown process 114. Alternately, if it is determined that the register Start condition is On, then control is passed to decision 124 in which the temperature detected by temperature sensor 46 is analyzed to determine whether the temperature is greater than a primary temperature condition, in this case, 40°. If the temperature is greater than 40°, then control is passed to process 126 in which a heater switching unit 58 is placed in the Off condition. Subsequent control passes to decision 128 in which a determination of the wind condition is made using wind sensor 48. If it is determined that wind velocities are within acceptable parameters, then control is passed to decision 130 in which any other environmental factors are sensed by environmental unit 42. Assuming that test is passed, then control is passed to process 132 in which the irrigation switching unit 50 is enabled, allowing irrigation controller 16 to have a direct link to and control of irrigation valve 14. Control is then passed to decision 122 for redetermination of the condition of the register Start.

Alternately, if in decision 124 the temperature is determined to be below the primary temperature regime, in this case 40°, or in decision 128 the wind is determined to be above an acceptable velocity, or in decision 130 any other environmental factors are determined not to be within acceptable limits, then in all three cases control is passed to process 134 in which the link between the irrigation controller 16 and the irrigation valve 14 as provided by switching unit 50 is broken, assuring that the irrigation system is disabled. Control is then passed to decision 136 in which it is determined whether temperature has fallen below a secondary temperature regime, in this case 32°. If the temperature is above 32°, then control is passed back to decision 122 for a redetermination of the start condition. Alternately, if it is determined that the temperature is less than or equal to this secondary temperature, in this case 32°, then control is passed to process 138 in which switching unit 58 is closed thereby energizing heater 36 to assure that the above ground portions of the circuit do not, under these possibly mild freezing conditions, go into a freeze up state. This is the only action initiated if, in the subsequent decision 140, it is determined that temperature is above the tertiary temperature condition, in this case 28°, in which case control is passed to start analysis process 122. Alternately, if it is determined in decision 140 that the temperature is less than or equal to this tertiary regime, indicating severe freezing conditions, then a system shut down is indicated and control is passed to system shut down process 114.

This constitutes the processing connected with the freeze prevention system. While there has been described above the principles of the present invention in conjunction with specific apparatus, it is to be clearly understood that the foregoing description is made only by way of example and not as a limitation to the scope of the invention.

GLOSSARY OF TERMS

Freeze Prevention Controller (38). A device which protects an irrigation system from freeze damage and from irrigating at times when it could be hazardous, undesirable or unnecessary.

Irrigation Controller (16). Ranges in complexity from systems operated in a residential setting by an electromechanical timer to systems operating a municipal system of parks with local controllers linked by satellite to a command center.

Sequential Logic Unit (40). Any device capable of sensing inputs and responding to them to produce predictable outputs.

Main Feedwater Supply Valve (24). Main valve controlling water to the irrigation system.

Drain Valves (28, 30). Valves which drain the above ground portion of an irrigation system. They may be remotely controlled or pressure actuated.

Vent Valves (32, 34). Remotely controlled valves located either on the backflow preventor itself or on each side of it.

Irrigation Valve (14). Remote controlled valve(s) which supply an irrigation network.

Heating Unit (36). A device to provide heat to the above ground components of the irrigation system.

Pressure Sensor (26). Any device which can determine if a section of pipe is under pressure.

Environmental Sensors (42, 46, 48). Any sensor which provides information about the irrigation environment.

Temperature Sensor (46). Any device capable of sensing the temperature near the above ground portion of the irrigation system.

Alarm Unit (62). May range in complexity from a simple audio or visual alarm to an alarm and system condition broadcast to a remote command center.

Backflow Preventor (8). Prevents back flow from an irrigation system back in the municipal water supply.

Primary Temperature Set Point. Temperature which has been determined to be hazardous enough to trigger the freeze prevention controller to disable the irrigation valves.

Secondary Temperature Set Point. Temperature which has been determined to be hazardous enough to trigger the freeze prevention controller to disable the irrigation valves and turn on the heating unit.

Tertiary Temperature Set Point. Temperature which has been determined to be hazardous enough to trigger the freeze prevention controller to disable the irrigation valves, turn on the heating unit and drain the above ground portion of the irrigation system.

What is claimed is:

1. A freeze prevention module for an irrigation system, said irrigation system comprising a feedwater supply line providing input to a feedwater supply valve which feedwater valve provides input to an irrigation valve which irrigation valve provides input to an irrigation network and an irrigation controller connected to the irrigation valve and capable of opening and closing said irrigation valve to provide irrigation, said freeze prevention module comprising:

a temperature sensing unit capable of detecting a freezing hazard condition and capable of transmitting a hazard condition signal;

a protection device capable of automatically and selectively closing said supply valve and providing an air vent path and a liquid drain path from said irrigation system to protect said system from freezing in response to receipt of a protection activation signal; and a freeze prevention controller connected to said temperature sensing unit, the feedwater supply valve and to said protection device, said freeze prevention controller capable of transmitting a protection activation signal to close the feedwater supply valve and to activate said protection device in response to receipt of said hazard condition signal.

2. The freeze prevention module of claim 1, wherein said protection device comprises:

at least one remotely operable drain valve connected to the irrigation system and to the freeze prevention controller, said drain valve capable of opening to drain the irrigation system in response to receipt of a protection activation signal from said freeze prevention controller.

3. The freeze prevention module of claim 1, wherein said protection device comprises:

a heating unit in thermal contact with the irrigation system and responsive to signal transmission from the freeze prevention controller, said heating unit capable of thermal activation in response to receipt of a protection activation signal from said freeze prevention controller.

4. The freeze prevention module of claim 1, further comprising:

an alarm unit connected to said freeze prevention controller, said alarm unit emitting an alarm signal in response to receipt of a protection activation signal from said freeze prevention controller.

5. The freeze prevention module of claim 1, wherein said protection device comprises:

a pressure sensing unit connected to the irrigation system downstream of said supply valve, said pressure sensing unit capable of confirming closure of said feedwater supply valve and transmitting a closure confirmation signal;

at least one drain valve connected to the irrigation system, said freeze prevention controller and said pressure sensing unit, said drain valve capable of opening to drain the irrigation system in response to receipt of a protection activation signal from said freeze prevention controller upon a closure confirmation signal from said pressure sensing unit.

6. The freeze prevention module of claim 2, wherein said protection device comprises:

a pressure sensing unit connected to the irrigation system downstream of said feedwater supply valve, said pressure sensing unit capable of confirming closure of said feedwater supply valve and transmitting a closure confirmation signal;

at least one remotely operable vent valve downstream of said feedwater supply valve connected to the irrigation system, said freeze prevention controller and said pressure sensing unit, said vent and drain valves capable of opening to drain the irrigation system in response to receipt of a protection activation signal from said freeze prevention controller upon a closure confirmation signal from said pressure sensing unit.

7. A process for freeze prevention of an irrigation system, said irrigation system comprising a feedwater supply line providing input to a feedwater supply valve which feedwater valve provides input to an irrigation valve which irrigation valve provides input to an irrigation network and an irrigation controller connected to the irrigation valve and capable of opening and closing said irrigation valve to provide irrigation, said freeze prevention process comprising:

sensing a freezing hazard temperature;

automatically closing the feedwater supply valve;

automatically and selectively opening a vent path and a drain path in the irrigation system; and monitoring said irrigation system for pressure downstream of said feedwater supply valve when said feedwater supply valve is closed.

8. A process for freeze prevention protecting an irrigation system, said irrigation system comprising a feedwater supply line providing input to an automatic feedwater supply valve which feedwater valve provides input to an automatic irrigation valve which irrigation valve provides input to an irrigation network and an irrigation controller connected to the automatic irrigation valve and capable of opening and closing said irrigation valve to provide irrigation, said freeze prevention protection process comprising:

sensing a freezing hazard temperature;

closing the automatic feedwater supply valve;

monitoring said irrigation system for pressure downstream of said feedwater supply valve when said feedwater supply valve is closed; and heating the irrigation system to prevent freeze damage.

9. A process for freeze prevention of an irrigation system, said irrigation system comprising a feedwater supply line providing input to a feedwater supply valve which feedwater valve provides input to an irrigation valve which irrigation valve provides input to an irrigation network and an irrigation controller connected to the irrigation valve and capable of opening and closing said irrigation valve to provide irrigation, said freeze prevention process comprising:

sensing a freezing hazard temperature;

closing the feedwater supply valve upon sensing said freezing hazard temperature; and automatically providing a vent path and a drain path between said feedwater valve and said irrigation valve upon closing the feedwater supply valve to prevent freeze prevention damage.

10. The process of claim 9 further comprising the step of:

activating an alarm condition signal in response to said step of sensing a freezing hazard temperature.

11. A freeze protected irrigation system, connected to a feedwater supply line by a feedwater supply valve, said freeze protected irrigation system comprising:

an irrigation valve connected to said feedwater supply valve which irrigation valve provides input to an irrigation network;

an irrigation controller connected to said irrigation valve and capable of opening and closing said irrigation vane to provide irrigation to the irrigation network;

a temperature sensing unit capable of detecting a freezing hazard condition and capable of transmitting a hazard condition signal;

a protection device automatically closing said feedwater supply valve and selectively providing a vent path and a drain path from said irrigation system upon sensing a low fluid pressure downstream of said supply valve when said supply valve is closed, said device being capable of protecting said irrigation system from freezing and capable of activation in response to receipt of a protection activation signal; and a freeze prevention controller connected to said temperature sensing unit, the feedwater supply valve and to said protection device, said freeze prevention controller capable of transmitting a protection activation signal and to activate said protection device in response to receipt of said hazard condition signal.

12. The freeze protected irrigation system of claim 11, wherein said protection device comprises:

at least one remotely operable drain valve connected to the irrigation system and to the freeze prevention controller, said drain valve selectively opening to drain the irrigation system in response to receipt of a protection activation signal from said freeze prevention controller.

13. The freeze protected irrigation system of claim 11, wherein said protection device comprises:

a heating unit in thermal contact with the irrigation system and responsive to signal transmission from the freeze prevention controller, said heating unit capable of thermal activation in response to receipt of a protection activation signal from said freeze prevention controller.

14. The freeze protected irrigation system of claim 11, further comprising:

an alarm unit connected to said freeze prevention controller, said alarm unit emitting an alarm signal in response to receipt of a protection activation signal from said freeze prevention controller.

15. The freeze protected irrigation system of claim 11, wherein said protection device comprises:

a pressure sensing unit connected to the irrigation system downstream of said feedwater supply valve, said pressure sensing unit capable of confirming closure of said feedwater supply valve and transmitting a closure confirmation signal;

at least one remotely operable drain valve connected to the irrigation system, said freeze prevention controller and said pressure sensing unit, said drain valve selectively opening to drain the irrigation system in response to receipt of a protection activation signal from said freeze prevention controller and a closure confirmation signal from said pressure sensing unit.

16. The freeze protected irrigation system of claim 11, wherein said protection device comprises:

a pressure sensing unit connected to the irrigation system downstream of said feedwater supply valve, said pressure sensing unit capable of confirming closure of said feedwater supply valve and transmitting a closure confirmation signal;

at least one remotely operable vent valve and at least one remotely operable drain valve connected to the irrigation system, said freeze prevention controller and said pressure sensing unit, said vent valve and said drain valve capable of selectively opening to drain the irrigation system in response to receipt of a protection activation signal from said freeze prevention controller upon a closure confirmation signal from said pressure sensing unit.

17. A process for freeze prevention of an irrigation system, said irrigation system comprising a feedwater supply line providing input to a feedwater supply valve which feedwater valve provides input to an irrigation valve which irrigation valve provides input to an irrigation network and an irrigation controller connected to the irrigation valve and capable of opening and closing said irrigation valve to provide irrigation, said freeze prevention process comprising:

sensing a primary hazard temperature;

closing the irrigation valve;

sensing a secondary hazard temperature;

heating the irrigation system to prevent freeze prevention damage;

sensing a tertiary hazard temperature;

closing the feedwater supply valve upon sensing said tertiary hazard temperature;

automatically and selectively opening a vent valve and a drain valve in the irrigation system upon said closing the feedwater supply valve.

18. The process of claim 17 further comprising the step of:

activating an alarm condition signal in response to said step of closing the feedwater supply valve.

* * * * *